US006834227B2

(12) United States Patent
Saito et al.

(10) Patent No.: US 6,834,227 B2
(45) Date of Patent: Dec. 21, 2004

(54) FAULT DIAGNOSIS APPARATUS OF FUEL EVAPORATION/DISSIPATION PREVENTION SYSTEM

(75) Inventors: Kenji Saito, Nagoya (JP); Hidetsugu Kanao, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/601,622

(22) Filed: Jun. 24, 2003

(65) Prior Publication Data

US 2004/0068360 A1 Apr. 8, 2004

(30) Foreign Application Priority Data

Jun. 25, 2002 (JP) ..... 2002-185129
Apr. 24, 2003 (JP) ..... 2003-120518

(51) Int. Cl.[7] ..... F02M 25/08; F02D 41/22
(52) U.S. Cl. ..... 701/114; 123/520; 73/118.1
(58) Field of Search ..... 701/114, 102; 123/519, 520, 479, 480, 486; 73/117.3, 118.1

(56) References Cited

U.S. PATENT DOCUMENTS 5,275,144 A * 1/1994 Gross ..... 123/520
5,411,007 A * 5/1995 Narita ..... 123/520
5,699,775 A * 12/1997 Azuma ..... 123/520
5,829,416 A 11/1998 Teraoka et al. ..... 123/520
5,878,728 A * 3/1999 Kidokoro et al. ..... 123/520

FOREIGN PATENT DOCUMENTS

JP 8-218951 A 8/1996
JP 8-270512 A * 10/1996 ..... F02M/25/08
JP 9-177617 A * 7/1997 ..... F02M/25/08
JP 9-303218 A 11/1997

* cited by examiner

*Primary Examiner*—Hieu T. Vo
(74) *Attorney, Agent, or Firm*—Birch, Stewart, Kolasch & Birch, LLP

(57) ABSTRACT

When a first restoring pressure amount, measured after a fault diagnosis object region is in a reduced pressure state, exceeds a first or second judgment value, a second restoring pressure amount is measured by releasing the fault diagnosis object region to the atmosphere and then sealing it. When the first restoring pressure amount is between the first and second judgment values, the second restoring pressure amount is compared with a third judgment value. When the first restoring pressure amount exceeds the second judgment value, the second restoring pressure amount is compared with a fourth judgment value. Leak is determined to exist when the first restoring pressure amount exceeds the first judgment value and the second restoring pressure amount does not exceed the third judgment value, or when the first restoring pressure amount exceeds the second judgment value and the second restoring pressure amount does not exceed the fourth judgment value.

8 Claims, 13 Drawing Sheets

S1: Is diagnosis condition established?
S2: measurement of tank internal pressure increment ΔP1
S4: ΔP measurement
S11A: L1 is set in accordance with ΔP
S13: measurement of re-ΔP1
S14A: re-ΔP1 > L1?

S1: Is diagnosis condition established?

S2: measurement of tank internal pressure increment ΔP1

S4: ΔP measurement

S13' re-ΔP1 measurement
S14' re-ΔP1 > L2'
S15' leak judgment

S1: Is diagnosis condition established?

S2: measurement of tank internal pressure increment ΔP1

S4: ΔP measurement

S11A: L4 is set in accordance with ΔP

S13: measurement of re-ΔP1

S14A: re-ΔP1 > L4?

12: atmospheric pressure sensor

S202: Set L22 in accordance with decrement of atmospheric pressure
S204: Set L21 in accordance with decrement of atmospheric pressure

FAULT DIAGNOSIS APPARATUS OF FUEL EVAPORATION/DISSIPATION PREVENTION SYSTEM

The entire disclosure of Japanese Patent Application No. P2002-185129 filed on Jun. 25, 2002 and Japanese Patent Application No. P2003-120518 filed on Apr. 24, 2003 including specification, claims, drawings, and summary is incorporated herein by reference in its entirety.

BACKGROUND OF THE INVENTION

1. Field of the Invention

This invention relates to a fault diagnosis apparatus of a fuel evaporation/dissipation prevention system.

2. Description of the Related Art

A fuel evaporation/dissipation prevention system is provided in an automobile to prevent emission of evaporated fuel occurring inside a fuel tank into the atmosphere. The fuel evaporation/dissipation prevention system includes a canister, a vapor passage extending between a fuel tank and the canister and having a purge valve fitted thereto, and a purge passage extending between the canister and an intake passage of an internal combustion engine. The canister adsorbs the evaporated fuel inside the fuel tank through the vapor passage. On the other hand, the purge valve is opened under a predetermined condition so that the evaporated/dissipated fuel adsorbed to the canister can be purged into the intake passage of the internal combustion engine through the purge passage.

A fault diagnosis apparatus for detecting leak abnormality of the fuel evaporation/dissipation prevention system is provided to this prevention system. The fault diagnosis apparatus includes a vent valve fitted to the canister, a pressure sensor for detecting an internal pressure of the fuel tank, and an electronic control unit (ECU) for inputting detection information from the pressure sensor and controlling opening/closing of the vent valve and the purge valve. To make fault diagnosis, the fault diagnosis apparatus opens the purge valve and closes the vent valve to bring the fuel tank, the vapor passage, and the purge passage as the fault diagnosis object regions of the fuel evaporation/dissipation prevention system into a predetermined negative pressure state. The fault diagnosis apparatus then closes the purge valve, measures the internal pressure of the fuel tank while the fault diagnosis object regions are thus closed, and judges that leak abnormality exists when an increment of the tank internal pressure is greater than a judgment value.

However, because the increase of the tank internal pressure occurs owing to various factors, an erroneous judgment is likely to be made when leak judgment is made on the basis of the comparison result of the increment of the tank internal pressure with the judgment value. One of the causes of the increase of the tank internal pressure is that external air flows into the tank through a small hole formed in the fuel tank. On the other hand, even when no leak occurs in the fuel tank, the tank internal pressure rises due to evaporation/dissipation of the fuel when the degree of evaporation saturation of the fuel inside the tank is low. The fuel is returned from the internal combustion engine into the fuel tank through a low-pressure fuel passage. This return fuel is also a cause of the increase of the evaporation dissipation amount. Particularly, when the fuel remaining amount becomes small inside the tank, evaporation/dissipation of the fuel due to this return fuel becomes remarkable inside the tank. A winter fuel is used at cold places from fall to spring. Because the winter fuel has a larger content of alcohol, that is, a larger evaporation/dissipation amount, fuel evaporation/dissipation is remarkable particularly on warm days. The causes of the increase of the internal pressure of the fuel tanks as criteria of the fault diagnosis can thus be divided into the leak hole and fuel evaporation/dissipation. In order to make a correct fault diagnosis, it is therefore necessary to correctly judge the causes of the increase of the tank internal pressure.

Therefore, fault judgment is tentatively made when the increment of the tank internal pressure, measured under the closed condition after the fault diagnosis object region, is brought into a reduced pressure state exceeds a first judgment value, then the increment of the tank interval pressure is measured while the fault diagnosis object region is released to the atmosphere and then closed, and final judgment is then made by comparing this measurement value with a second judgment value. In other words, when the increment of the tank internal pressure after the release to the atmosphere is smaller than the second judgment value, final judgment is made to the effect that a leak hole exists. When the increment of the tank internal pressure is greater than the second judgment value, on the other hand, the tank internal pressure is judged as increasing due to evaporation/dissipation of the fuel. In this case, the tentative fault judgment is withdrawn and final judgment is made to the effect that existence/absence of the leak hole is not known (diagnosis result by high evaporation/dissipation judgment is invalidated).

Demands have increased in recent years to prevent ultra-trace amount leak in the fuel evaporation/dissipation prevention system. Ultra-small leak holes as the main cause of this ultra-trace amount leak have diameters of about 0.5 mm. On the other hand, the small leak holes that have so far been the object of detection have diameters of about 1.0 mm, and the diameters of both holes are remarkably different. When the leak holes having different diameters are the objects of detection in fault diagnosis of the fuel evaporation/dissipation prevention system, it becomes more difficult to correctly discriminate whether the increment of the tank internal pressure results from the leak holes or from evaporation/dissipation of the fuel. In other words, the smaller the diameter of the hole, the smaller becomes the increment of the tank internal pressure resulting from the leak hole. To discriminate the increase of the tank internal pressure resulting from the ultra-small leak hole from the increase of the tank internal pressure resulting from evaporation/dissipation of the fuel, the second judgment value must be lowered. When the second judgment value is set to a smaller value, however, the increment of the tank internal pressure under the closed state after the release to the atmosphere is likely to exceed the second judgment value. Therefore, even when the small leak hole exists and is tentatively judged as existing, the number of cases where the increment of the tank internal pressure under the closed state after the release to the atmosphere exceeds the second judgment value and leak judgment is withdrawn becomes greater, and trace amount leak resulting from the small leak hole cannot be detected.

It is an object of the present invention to provide a fault diagnosis apparatus capable of accurately judging abnormality resulting from trace amount leak and ultra-trace amount leak in the evaporated fuel dissipation prevention system.

SUMMARY OF THE INVENTION

In the fault diagnosis apparatus according to the invention, when a first restoring pressure amount measured after a fault diagnosis object region of the fuel evaporation/dissipation prevention system is brought into a reduced pressure state exceeds a first judgment value or a second judgment value greater than the first judgment value, a second restoring pressure amount is measured by sealing the fault diagnosis object region after an atmospheric pressure is introduced into the fault diagnosis object region, the second restoring pressure amount is compared next with a third judgment value when the first restoring pressure amount is greater than the first judgment value but is smaller than the second judgment value, and the second restoring pressure amount is compared with a fourth judgment value greater than the third judgment value when the first restoring pressure amount is greater than the second judgment value. When the first restoring pressure amount is greater than the first judgment value and the second restoring pressure amount is smaller than the third judgment value, or when the first restoring pressure amount is greater than the second judgment value and the second restoring pressure amount is smaller than the fourth judgment value, the fuel evaporation/dissipation prevention system is judged as being abnormal.

The increment of the first restoring pressure amount resulting from the leak hole changes with a leak hole diameter. Therefore, it is difficult to judge existence/absence of the leak holes having various diameters without being affected by evaporation/dissipation of the fuel. The fault diagnosis apparatus according to claim 1 can set, respectively, the first and second judgment values in association with ultra-trace amount leak and trace amount leak (for example, ultra-small leak hole and small hole respectively inducing ultra-trace amount leak and trace amount leak) and can also set the third and fourth judgment values so that abnormality resulting from ultra-trace amount leak and trace amount leak can be distinguished from abnormality resulting from evaporation/dissipation of the fuel. Therefore, ultra-trace amount leak and trace amount leak can be distinguished from the increase of the restoring pressure amount resulting from the fuel evaporation/dissipation and can be correctly judged on the basis of the restoring pressure amount.

In other words, when the first restoring pressure amount exceeds the first judgment value as the judgment criterion of ultra-trace amount leak but is smaller than the second judgment value as the judgment criterion of trace amount leak, abnormality resulting from ultra-trace amount leak is judged tentatively. Next, the second restoring pressure amount is measured in order to discriminate whether such an increase of the first restoring pressure amount results from ultra-trace amount leak or from evaporation/dissipation of the fuel. When the second restoring pressure amount exceeds the third judgment value, evaporation/dissipation of the fuel is judged as being the cause of the increase of the first restoring pressure amount. In consequence, tentative judgment of ultra-trace amount leak abnormality is withdrawn, and final judgment is made to the effect that existence/absence of ultra-trace amount leak is not known (diagnosis result by high evaporation/dissipation judgment is invalidated). When the second restoring pressure amount does not exceed the third judgment value, on the other hand, ultra-trace amount leak is judged as being the cause of the increase of the first restoring pressure amount, and ultra-trace amount leak abnormality is finally judged.

When the first restoring pressure amount exceeds the second judgment value, abnormality resulting from trace amount leak is judged tentatively. Next, the second restoring pressure amount is measured to discriminate the cause of the increase of the first restoring pressure amount. When the second restoring pressure amount exceeds the fourth judgment value, evaporation/dissipation of the fuel is judged as being the cause by the increase of the first restoring pressure amount, and final judgment is made to the effect that existence/absence of trace amount leak is not known (diagnosis result by high evaporation/dissipation judgment is invalidated). When the second restoring pressure amount does not exceed the fourth judgment value, on the other hand, trace amount leak is judged as being the cause of the increase of the first restoring pressure amount, and trace amount leak abnormality is finally judged as existing.

As described above, the fault diagnosis apparatus according to the present invention can correctly judge ultra-trace amount leak and trace amount leak, respectively, resulting from the ultra-small leak hole and the small leak hole.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

First Embodiment

A fault diagnosis apparatus according to the present invention will be hereinafter explained with reference to the accompanying drawings.

Figure 1:
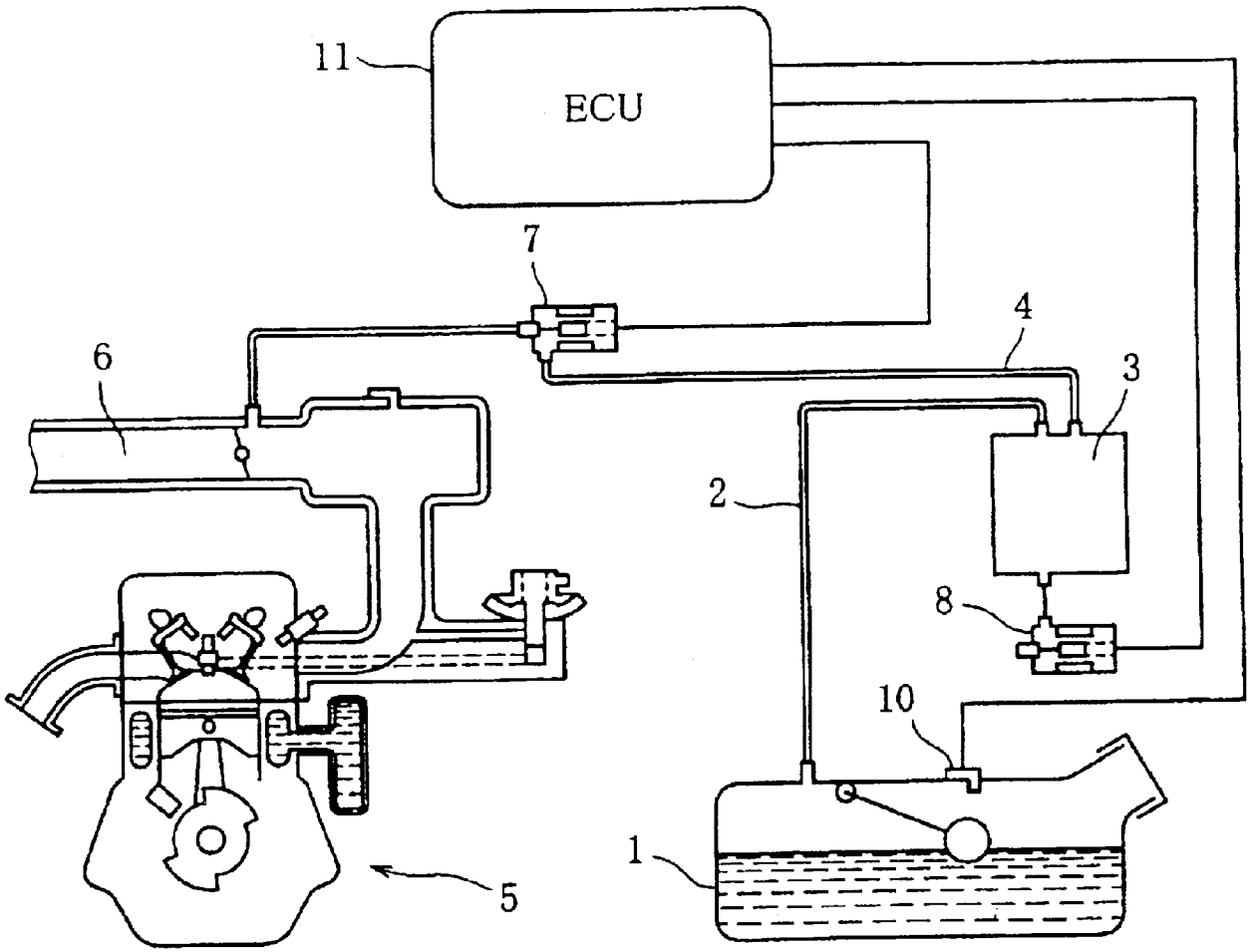
FIG. 1 is a schematic view of a fuel evaporation/dissipation prevention system equipped with a fault diagnosis apparatus according to a first embodiment of the present invention.

As shown in FIG. 1, in a fuel evaporation/dissipation prevention system equipped with a fault diagnosis apparatus, a canister 3 adsorbs an evaporated/dissipated fuel inside a fuel tank 1 through a vapor passage 2. When a predetermined purge condition is established, a purge valve 7 arranged in a purge passage 4 is opened under control of an ECU 11 to emit the evaporated/dissipated fuel adsorbed to the canister 3 into an intake passage 6 of an internal combustion engine 5 through the purge passage 4 and to thus prevent emission of the evaporated/dissipated fuel into the atmosphere.

The fault diagnosis apparatus according to the first embodiment of the present invention diagnoses existence/absence of leak abnormality in the fuel evaporation/dissipation prevention system. The fault diagnosis apparatus includes a vent valve 8 fitted to the canister 3, a pressure sensor 10 for detecting the tank internal pressure, fitted to the fuel tank 1, and the ECU 11 for controlling opening/closing of the purge valve 7 and the vent valve 8.

In the fuel evaporation/dissipation prevention system equipped with the fault diagnosis apparatus, when the purge valve 7 is opened while the vent valve 8 is closed, the fuel tank 1 communicates with the intake passage 6 through the vapor passage 2 and through the purge passage 4. Therefore, the fuel tank 1 is brought into a reduced pressure state by the operation of the negative pressure inside the intake passage 6. When the purge valve 7 is closed and the vent valve 8 is opened, on the other hand, evaporation/dissipation of the fuel inside the fuel tank 1 elevates the internal pressure of the fuel tank 1 to about the atmospheric pressure.

Figure 2:
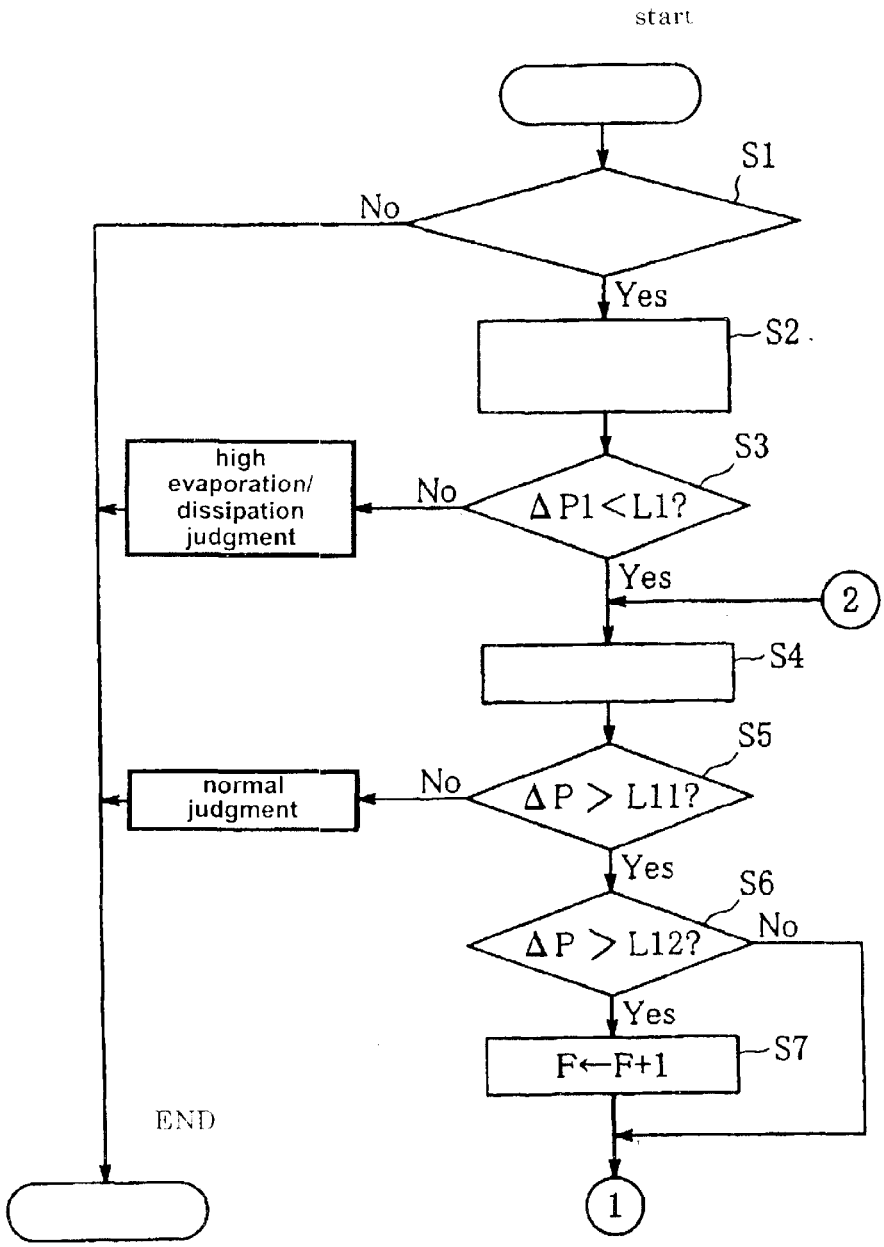
FIG. 2 is a flowchart showing a part of a fault diagnosis routine executed by an ECU shown in FIG. 1.
Figure 3:
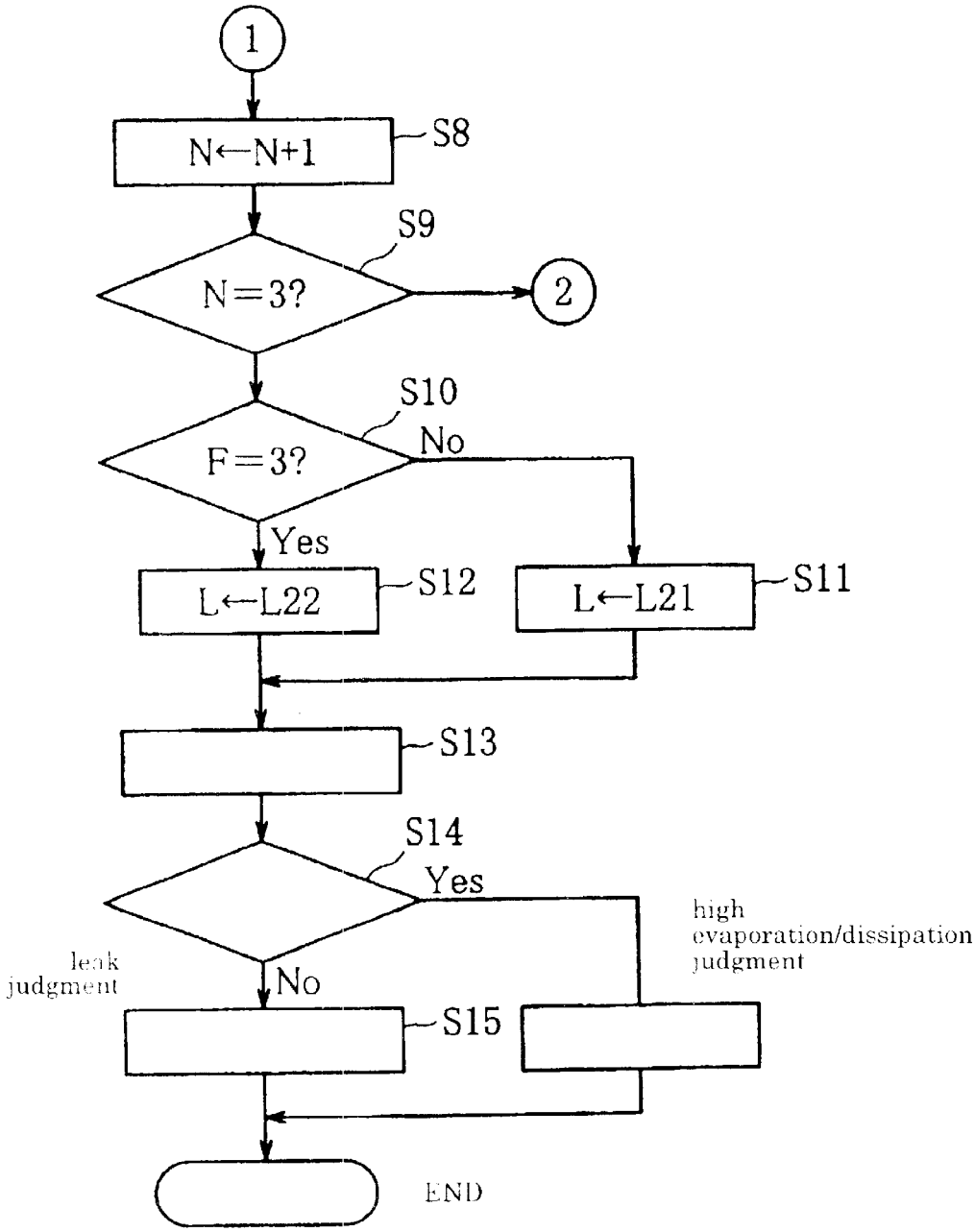
FIG. 3 is a flowchart showing the remaining part of the fault diagnosis routine continuing FIG. 2.

The ECU 11 of the fault diagnosis apparatus executes the fault diagnosis routine shown in FIGS. 2 and 3 when an ignition key of an automobile is turned ON and a cold start of the engine is conducted, for example.

In Step S1 of this fault diagnosis routine, the ECU 11 judges whether or not a fault diagnosis condition is established, that is, whether or not a start cooling water temperature and an intake temperature are below predetermined temperatures and whether or not a fuel temperature is below a predetermined temperature, a fuel remaining amount is within a predetermined range, and so forth.

Figure 4:
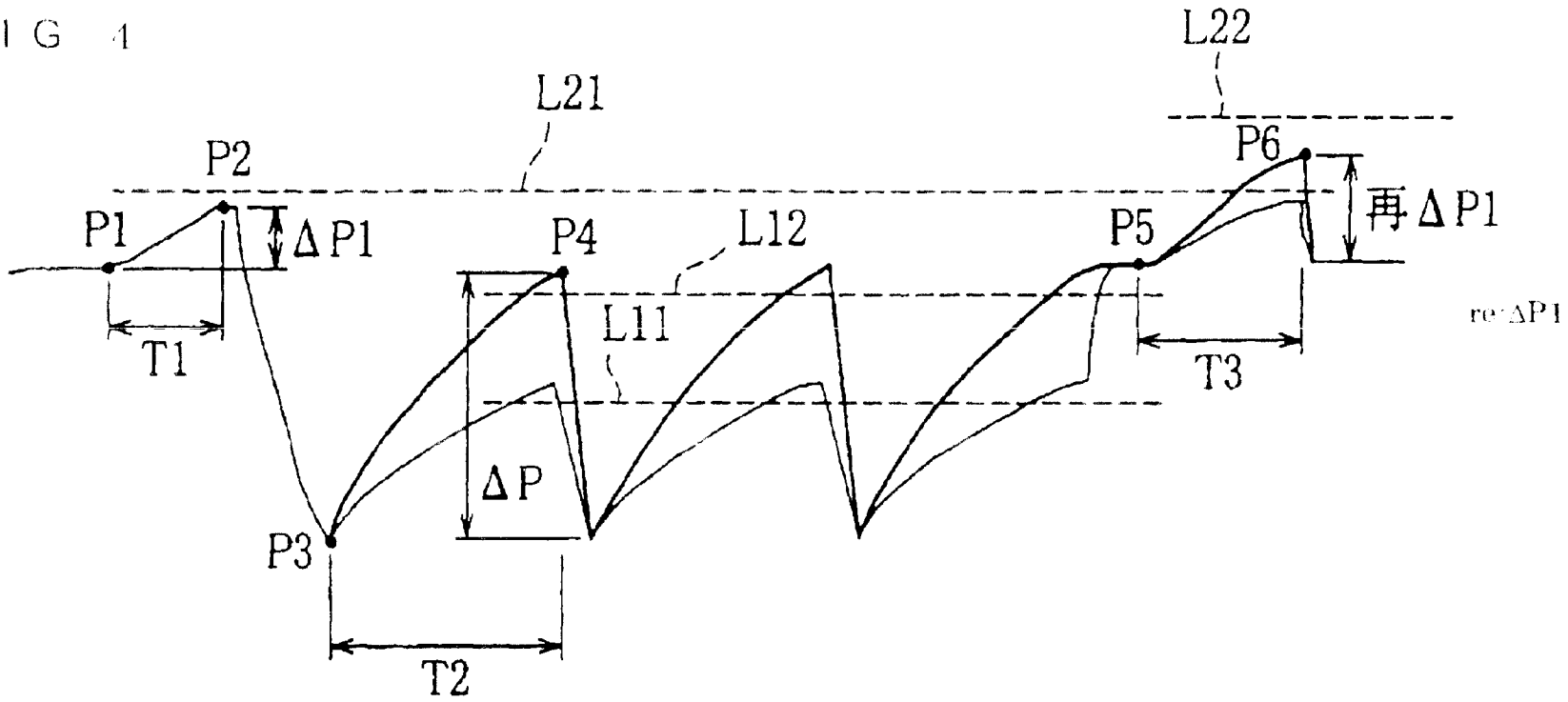
FIG. 4 is a graph showing a change of an internal pressure of a fuel tank with the passage of time during fault diagnosis.

When the fault diagnosis condition is not judged as being established in Step S1, the fault diagnosis in this cycle is finished. When the fault diagnosis condition is judged as established in Step S1, on the other hand, a tank internal pressure increment amount represented by symbol ΔP1 in FIG. 4 is measured (Step S2). To measure this ΔP1, the purge valve 7 is closed while the vent valve 8 is opened so that the fault diagnosis object region of the fuel evaporation/dissipation system can be released to the atmosphere. In this instance, the purge valve 7 may be gradually closed. The output of the pressure sensor 11 representing the tank internal pressure P1 under this atmosphere-released state is read. When the vent valve 8 is closed after the tank internal pressure P1 is measured, the tank internal pressure rises with the passage of time as shown in FIG. 4.

The output of the pressure sensor 11 is read when a predetermined time T1 passes from the measurement point of the tank internal pressure P1, and a tank internal pressure P2 is measured at this point. Next, a tank internal pressure increment amount ΔP1 is calculated from the tank internal pressures P1 and P2, and measurement of ΔP1 in Step S2 is finished.

In the next Step S3, whether or not the tank internal pressure increment amount ΔP1 obtained in step 2 is smaller than a high evaporation/dissipation judgment value L1 is judged. When the judgment result proves NO, judgment is made to the effect that correct fault diagnosis is not possible because of an excess fuel evaporation/dissipation, and the fault diagnosis is finished.

On the other hand, when the tank internal pressure increment amount ΔP1 is below a leak judgment value L1, fault judgment is further conducted. The purge valve 7 is first opened to bring the fault diagnosis object region into a reduced pressure state in Step S4 in FIG. 2. When the pressure detected by the pressure sensor 11 reaches a predetermined negative pressure value indicated by symbol P3 in FIG. 4, the purge valve 7 is closed to bring the fault diagnosis object region into a closed state. In the fault diagnosis object region under this closed state, the tank internal pressure increases with the passage of time due to evaporation or leak of the fuel inside the fuel tank 1 as shown in FIG. 4. In FIG. 4, thick solid line represents leak of a trace amount and thin solid line does leak of a ultra-trace amount. When a predetermined time T2 passes from the point of time at which the purge valve 7 is closed, the output of the pressure sensor 10 representing the tank internal pressure P4 at this point of time is read, and the tank internal pressure increment value ΔP as the first restoring pressure value is calculated from the tank internal pressures P3 and P4.

In the next Step S5, whether or not the first restoring pressure amount ΔP calculated in Step S4 is greater than a first judgment value L11 suitable for the judgment of the ultra-trace amount leak resulting mainly from a ultra-small leak hole is judged. When the judgment result proves NO, leak abnormality is not judged as existing and the fault diagnosis is finished.

On the other hand, when the first restoring pressure amount ΔP is greater than the first judgment value L11, whether or not the first restoring pressure amount ΔP is greater than a second judgment value L12 suitable for the judgment of trace amount leak resulting mainly from a small leak hole is judged (Step S6). When the judgment result of Step S6 proves YES, a value of a flag F representing the number of times that the first restoring pressure amount ΔP exceeds the second judgment value L12 is incremented by "1" in Step S7. The flow then proceeds to Step S8 of FIG. 3. When the judgment result in Step S6 proves NO, on the other hand, the flow immediately proceeds from Step S6 to Step S8, and the number of times of measurement of the first restoring pressure amount ΔP is incremented by "1". Next, whether or not the number of times of measurement N is equal to "3" is judged (Step S9). When the number of times of measurement of the first restoring pressure amount ΔP does not reach 3 times, the flow proceeds to Step S4 of FIG. 2 and the first restoring pressure amount ΔP is again measured.

When the first restoring pressure amount ΔP is measured three times in this way, the judgment result in Step S9 becomes YES, and whether or not the value of the flag F is "3" is judged in Step S10. When the judgment result in Step S10 is NO, that is, when all of the first restoring pressure amounts ΔP measured thrice are below the second judgment value L12, judgment is made tentatively that ultra-trace amount leak resulting mainly from a ultra-small leak hole exists. Next, a judgment value L used for high evaporation/dissipation judgment to be explained next is set to a third judgment value L21 suitable for discriminating ultra-trace amount leak from high evaporation/dissipation (Step S11). On the other hand, when the judgment result of Step S10 is YES, that is, when all the first restoring pressure amounts ΔP measured thrice exceed the second judgment value L12, judgment is tentatively made that trace amount leak resulting mainly from a small leak hole exists, and the judgment value L is set to a fourth judgment value L22 suitable for discriminating trace amount leak from high evaporation/dissipation (Step S12).

In the next Step S13, the purge valve 7 is closed while the vent valve 8 is opened so as to release the fault diagnosis object region to the atmosphere. After the tank internal pressure P5 under this atmosphere-released state is measured through the pressure sensor, the vent valve 8 is closed and the fault diagnosis object region is brought into the closed state. The tank internal pressure increases under this closed state with the passage of time as shown in FIG. 4. When a predetermined time T3 passes from the point of time at which measurement of the tank internal pressure P5 is finished, the output of the pressure sensor 10 is read, the tank internal pressure P6 at this point of time is measured, and re-ΔP1 as the second restoring pressure amount is calculated from the tank internal pressures P5 and P6.

In the next Step S14, whether or not this re-ΔP1 is greater than the judgment value L set in Step S11 or S12 is judged. When the judgment result proves NO, final judgment is made in Step S15 to the effect that leak exists. When the judgment result in Step S14 proves YES, on the other hand, judgment is made to the effect that because the increase of the first restoring amount ΔP results from high evaporation/dissipation, the tentative judgment that leak exists must be withdrawn, and the fault diagnosis is finished without making leak judgment. Incidentally, when leak is judged as existing, the leak judgment result is notified by use of an alarm lamp or an alarm buzzer.

In summary, in this embodiment the first and second judgment values L11 and L12 are set in association with ultra-trace amount leak and trace amount leak, respectively, and the third and fourth judgment values L21 and L22 are set so that abnormality resulting respectively from ultra-trace amount leak and from trace amount leak can be discriminated from abnormality resulting from evaporation/dissipation of the fuel. When the first restoring pressure amount ΔP exceeds the first judgment value L11 as the judgment criterion of ultra-trace amount leak and is below the second judgment value L12 as the judgment criterion of trace amount leak, abnormality resulting from the ultra-trace amount leak is tentatively judged. Next, the second restoring pressure amount (re-ΔP1) is measured in order to judge whether the increase of such a first restoring pressure amount results from ultra-trace amount leak or from excessive evaporation/dissipation of the fuel.

When the second restoring pressure amount exceeds the third judgment value L21, evaporation/dissipation of the fuel is judged as the cause of the increase of the first restoring pressure amount, and tentative judgment of ultra-trace amount leak abnormality is withdrawn and final judgment is made to the effect that existence/absence of ultra-trace amount leak is not known (diagnosis by high evaporation/dissipation judgment is invalidated). On the other hand, when the second restoring pressure amount does not exceed the third judgment value, ultra-trace amount leak is judged as being the cause of the increase of the first restoring pressure amount, and ultra-trace amount leak abnormality is judged finally.

When the first restoring pressure amount ΔP exceeds the second judgment value L12, abnormality resulting from trace amount leak is tentatively judged. Next, the second restoring pressure amount (re-ΔP1) is measured for judging the cause of the increase of the first restoring pressure amount. When the second restoring pressure amount exceeds the fourth judgment value L22, evaporation/dissipation of the fuel is judged as the cause of the increase of the first restoring pressure amount ΔP, and final judgment is made to the effect that existence/absence of trace amount leak is not known (diagnosis by high evaporation/dissipation judgment is invalidated). When the second restoring pressure amount does not exceed the fourth judgment value L22, on the other hand, trace amount leak is judged as the cause of the increase of the first restoring pressure amount and final judgment is made to the effect that trace amount leak exists. It becomes thus possible to accurately judge ultra-trace amount leak and trace amount leak.

Additionally, the ECU 11 of the fault diagnosis apparatus operates as first diagnosis means for comparing the first restoring pressure amount ΔP measured after pressure reduction of the fault diagnosis object region with the first judgment value L11 or the second judgment value L12, as second diagnosis means for comparing the second restoring pressure value (re-ΔP1) measured under the closed state after the fault diagnosis object region is released to the atmosphere with the third judgment value L21 or the fourth judgment value L22, and as abnormality judgment means for judging abnormality of the fuel evaporation/dissipation prevention system on the basis of the first and second restoring pressure amounts.

Figure 5:
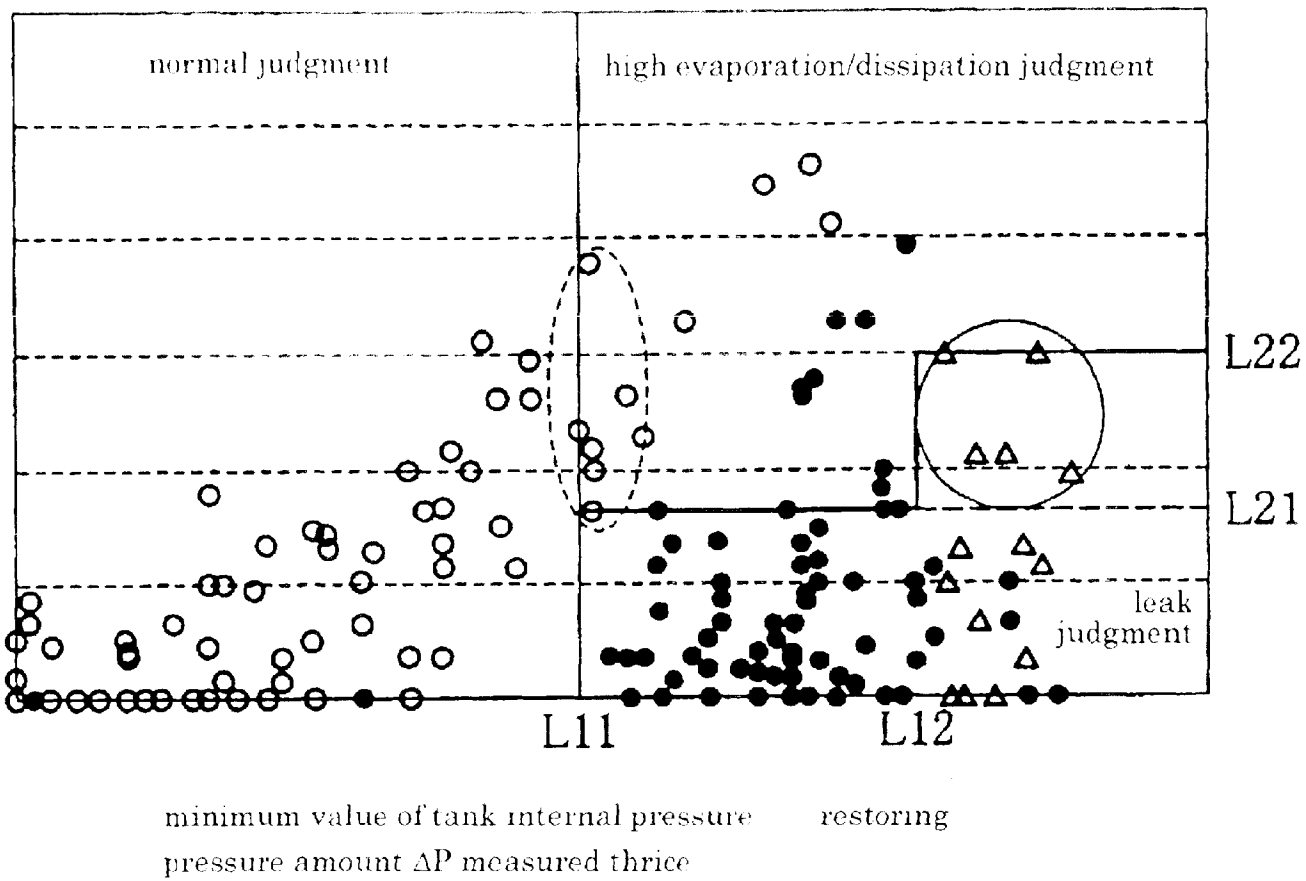
FIG. 5 is a graph showing accuracy of fault diagnosis by the fault diagnosis apparatus of the invention when the remaining amount of the fuel is large.
Figure 6:
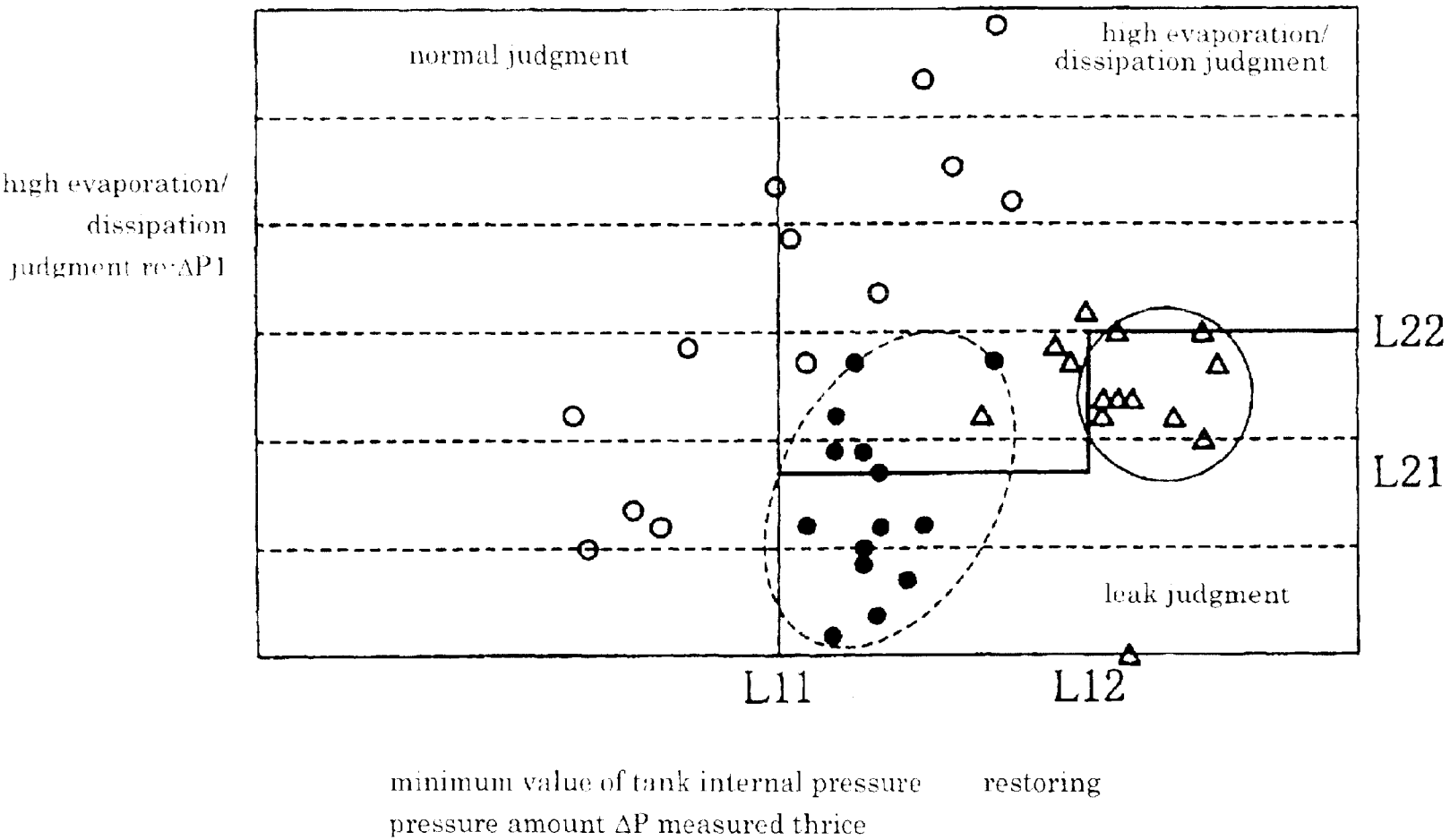
FIG. 6 is a graph showing accuracy of fault diagnosis by the fault diagnosis apparatus of the invention when the remaining amount of the fuel is small.

The inventors of the present invention have produced the fuel evaporation/dissipation prevention system equipped with the fault diagnosis apparatus as set forth in the embodiment described above, have set the first to fourth judgment values L11, L12, L21, and L22, and have evaluated fault diagnosis accuracy. FIG. 5 shows the fault diagnosis result when the fuel remaining amount inside the fuel tank 1 is from 40 to 85%. FIG. 6 shows the fault diagnosis result when the fuel remaining amount is from 15 to 40%. In FIGS. 5 and 6, "○" mark represents the diagnosis result of a fuel evaporation/dissipation prevention system without leak, "●" mark represents the diagnosis result of a fuel evaporation/dissipation prevention system provided with a ultra-small leak hole having a 0.5 mm diameter that causes ultra-trace amount leak, and "Δ" mark represents the diagnosis result of a fuel evaporation/dissipation prevention system provided with a small leak hole having a 1.0 mm diameter that causes trace amount leak.

It can be understood from FIG. 5 that, in the fuel evaporation/dissipation system without leak, the first restoring pressure value ΔP is in many cases below the first judgment value L11 and normal judgment is correctly made in most cases as represented by the "○" mark. When the first restoring pressure amount exceeds the first judgment value, the re-ΔP1 exceeds the third judgment value L21 or the fourth judgment value L22 and judgment is made as high evaporation/dissipation judgment. In other words, a correlation exists between the first restoring pressure amount ΔP and re-ΔP1. Since re-ΔP1 increases with the increase of the first restoring pressure amount ΔP, leak judgment is not made. As to the case represented by an oval region in FIG. 5, normal judgment can be made by variably setting the first judgment value L11 in accordance with the fuel temperature and the fuel remaining amount.

In the system having the ultra-small leak hole, leak judgment is made correctly in almost all the cases as represented by the "●" mark, but high evaporation/dissipation judgment is sometimes made when evaporation/dissipation of the fuel is great. In the system having the small leak hole, leak judgment is correctly made in almost all the cases as represented by the Δ mark. It can be understood that when the first restoring pressure amount ΔP exceeds the second judgment value L12 as in the case of a circle region in FIG. 5, in particular, leak judgment can be correctly made by use of the fourth judgment value L22 greater than the third judgment value L21 as the judgment criterion value of the second restoring pressure value (re-ΔP1).

As is apparent from FIG. 6, fault diagnosis accuracy analogous to that of FIG. 5 can be obtained also when the fuel remaining amount is small. As represented by the circle region in FIG. 6, in particular, the effect of using the fourth judgment value L22 appears remarkably. It has thus been confirmed that the fault diagnosis apparatus can be suitably used for fault diagnosis in the low fuel amount region. However, ultra-small leak is judged in some cases as high evaporation/dissipation as represented by the elliptic region in FIG. 6.

Second Embodiment

A fault diagnosis apparatus according to the second embodiment of the present will be explained.

The fault diagnosis apparatus according to this embodiment basically has the same construction as that of the first embodiment. In the fuel evaporation/dissipation prevention system according to the first embodiment, the first restoring pressure amount ΔP, measured under the closed state after pressure reduction of the fault diagnosis object region of the fuel evaporation/dissipation prevention system, is serially compared with the first and second judgment values L11 and L12, and the second restoring pressure amount (re-ΔP1), measured under the closed state after the fault diagnosis object region is released to the atmosphere, is compared with the third judgment value L21 or the fourth judgment value L22. In contrast, in this embodiment, the first restoring pressure value ΔP is compared with a first predetermined value L3, and a second predetermined value L4 to be compared with the second restoring pressure amount is set in accordance with the first restoring pressure amount ΔP.

Figure 7:
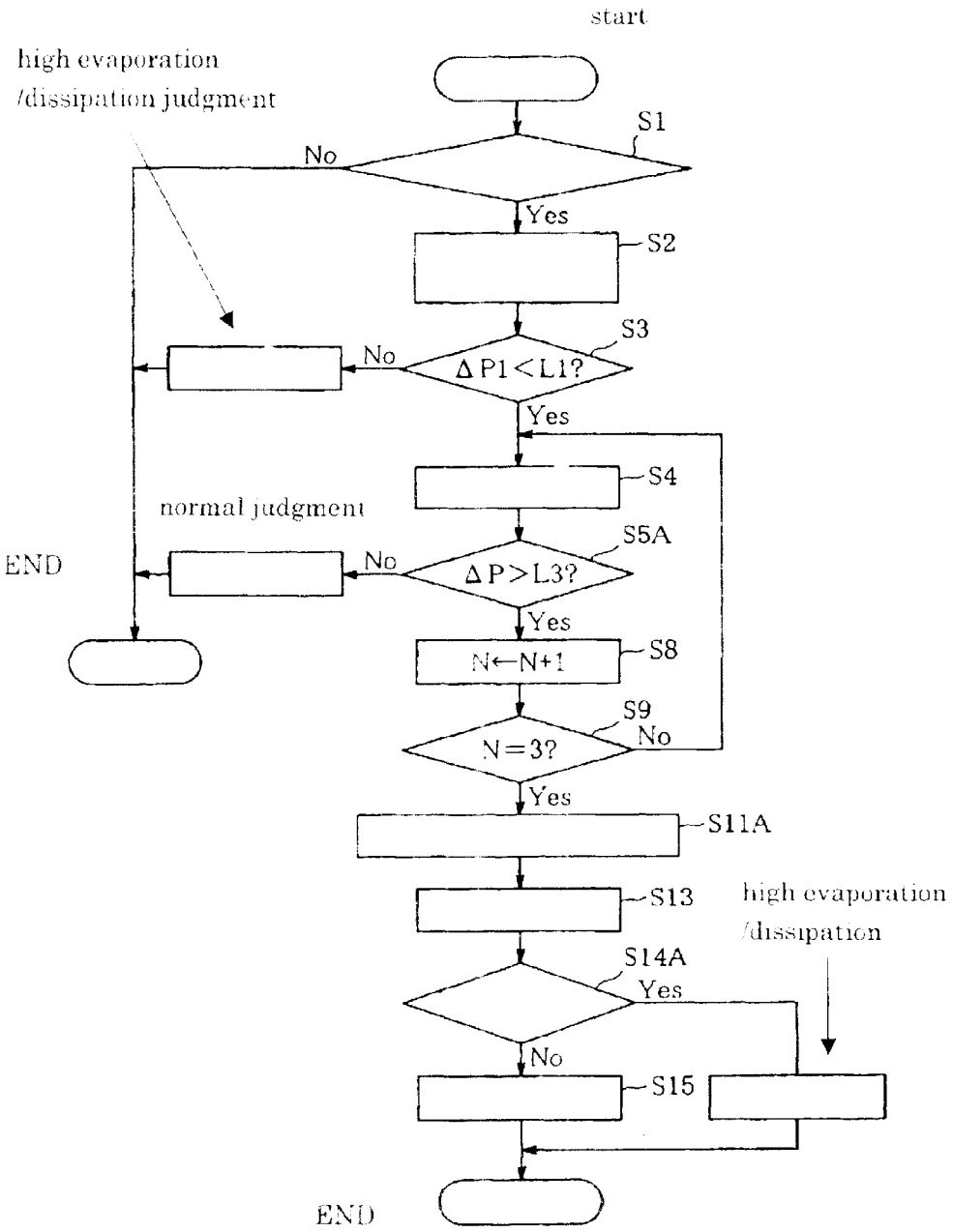
FIG. 7 is a flowchart showing a fault diagnosis routine executed by a fault diagnosis apparatus according to a second embodiment of the present invention.

More concretely, the ECU 11 of the fault diagnosis apparatus of this embodiment periodically executes the fault diagnosis routine shown in FIG. 7. In this fault diagnosis routine, Steps S1 to S5A corresponding respectively to Steps S1 to S5 in FIG. 2 are executed. In Step S5A, the first restoring pressure amount ΔP1 is compared with the first predetermined value L3 in place of the first judgment value L11 in Step S5 in FIG. 2. When the judgment result of Step 5A is YES, steps similar to Steps S8 and S9 in FIG. 3 are serially executed.

When the judgment result in Step S9 proves YES, that is, when all the first restoring pressure amounts ΔP1 measured thrice exceed the first predetermined value L3, the second predetermined value L4 is set in accordance with the first restoring pressure amount ΔP (the maximum value, the minimum value or the mean value of the first restoring pressure amounts ΔP measured thrice). More concretely, the second predetermined value L4 is set to a greater value when the first restoring pressure amount ΔP is greater (Step S11A). Next, Steps S13, S14A, and S15 respectively corresponding to Steps S13 to S15 in FIG. 3 are serially executed. In Step S14A, whether or not re-ΔP1 is greater than the second predetermined value L4 is judged.

The ECU 11 of the fault diagnosis apparatus operates as first diagnosis means for comparing the first restoring pressure amount ΔP measured after pressure reduction of the fault diagnosis object region of the fuel evaporation/dissipation prevention system with the first predetermined value L3, as second diagnosis means for comparing the second restoring pressure amount (re-ΔP1) measured under the closed state after the fault diagnosis object region is released to the atmosphere with the second predetermined value L4 and as abnormality judgment means for judging abnormality of the fuel evaporation/dissipation prevention system on the basis of the first and second restoring pressure amounts.

In the second embodiment, when the first restoring pressure amount ΔP exceeds the first predetermined value L3 as the judgment criterion of ultra-trace amount leak or trace amount leak, leak abnormality is tentatively judged. Next, the second restoring pressure amount (re-ΔP1) is measured for judging the cause of the increase of the first restoring pressure amount ΔP, and the second restoring pressure amount is compared with the second predetermined value L4. The second predetermined value L4 is set in accordance with the first restoring pressure amount ΔP and is adaptive to ultra-trace amount leak or trace amount leak. When the second restoring pressure amount exceeds the second predetermined value (third judgment value and fourth judgment value) L4, judgment is made that the increase of the first restoring pressure amount ΔP results from the excessive evaporation/dissipation of the fuel and tentative judgment of leak abnormality is withdrawn. When the second restoring pressure amount does not exceed the second predetermined value L4, on the other hand, judgment is made to the effect that the increase of the first restoring pressure amount ΔP results from leak abnormality, and leak abnormality is judged finally. As described above, the fault diagnosis apparatus according to this embodiment accurately discriminates ultra-trace amount leak from trace amount leak while preventing erroneous judgment resulting from evaporation/dissipation of the fuel.

The invention is not limited to the first and second embodiments given above, but can be changed or modified in various ways. For example, the features of the first and second embodiments maybe combined with one another. More concretely, the judgment value L may be set in accordance with the first restoring pressure amount ΔP in Steps S11 and S12 in FIG. 3. The invention can be changed or modified in various other ways within the scope of the invention.

Third Embodiment

A fault diagnosis apparatus according to a third embodiment of the present invention will be hereinafter explained.

Figure 8:
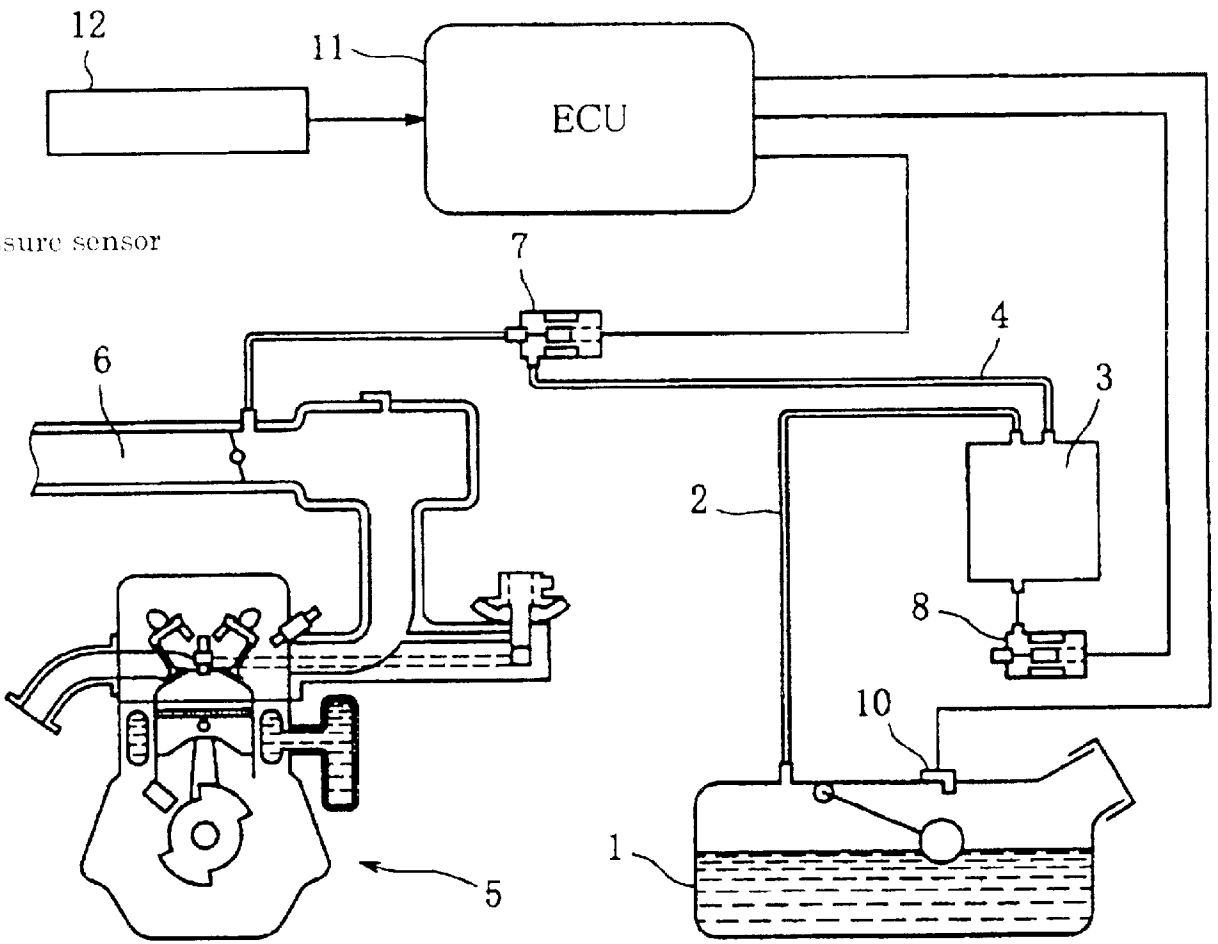
FIG. 8 is a schematic view showing a fuel evaporation/dissipation prevention system equipped with a fault diagnosis apparatus according to a third embodiment of the present invention.

The fault diagnosis apparatus of this embodiment is different from the first embodiment in that it is equipped with an atmospheric pressure sensor 12 as shown in FIG. 8 but is basically has the same construction. Therefore, detailed explanation will be omitted.

The fault diagnosis apparatus according to the third embodiment is employed for diagnosing existence/absence of leak abnormality in the fuel evaporation/dissipation system and includes a vent valve 8 fitted to a canister 3, a pressure sensor 10 for detecting a tank internal pressure, fitted to a fuel tank 1, an ECU 11 for controlling opening/closing of a purge valve 7 and the vent valve 8 and an atmospheric pressure sensor 12 connected to the input side of the ECU 11. The pressure sensor 10 comprises a relative pressure sensor for detecting a relative pressure inside and outside the fuel tank 1 as the fuel tank internal pressure. When the atmospheric pressure decreases with driving of the automobile having the apparatus of the present invention mounted thereto on a slope, the fuel tank internal pressure detected by the pressure sensor 10 increases by a decrement of the atmospheric pressure.

When the purge valve 7 is opened while the vent valve 8 is closed in the fuel evaporation/dissipation prevention system equipped with the fault diagnosis apparatus, the fuel tank 1 communicates with an intake passage 6 through a vapor passage 2 and a purge passage 2. In consequence, the internal pressure of the fuel tank 1 is reduced due to the operation of a negative pressure inside the intake passage 6. When the purge valve 7 is closed while the vent valve 8 is opened, on the other hand, the internal pressure of the fuel tank 1 increases to about the atmospheric pressure. When both of the purge valve 7 and the vent valve 8 are thereafter closed, the internal pressure of the fuel tank 1 increase above the atmospheric pressure due to evaporation and dissipation of the fuel inside the fuel tank 1.

Figure 9:
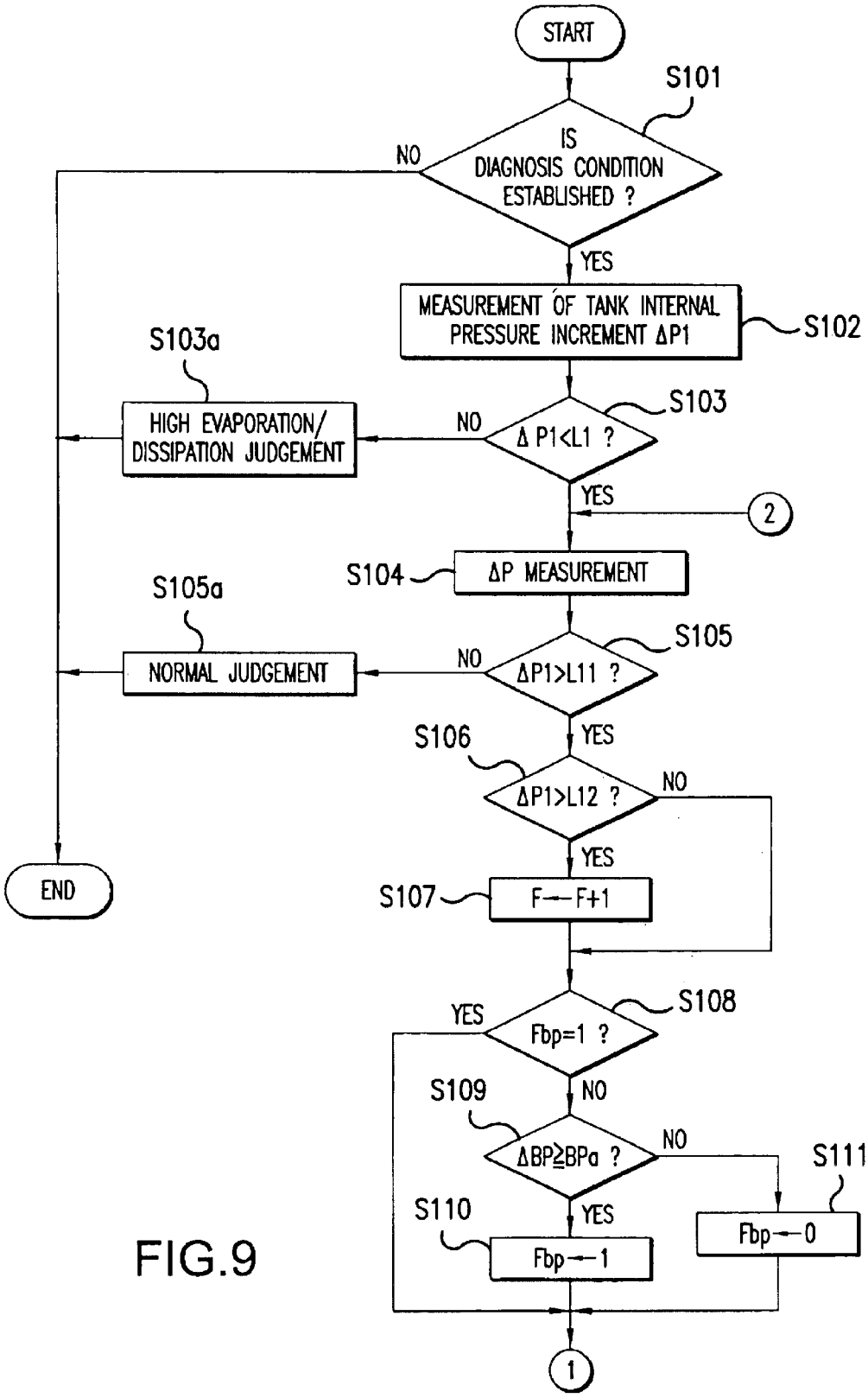
FIG. 9 is a flowchart showing a fault diagnosis routine executed by the fault diagnosis apparatus according to the third embodiment of the present invention.
Figure 10:
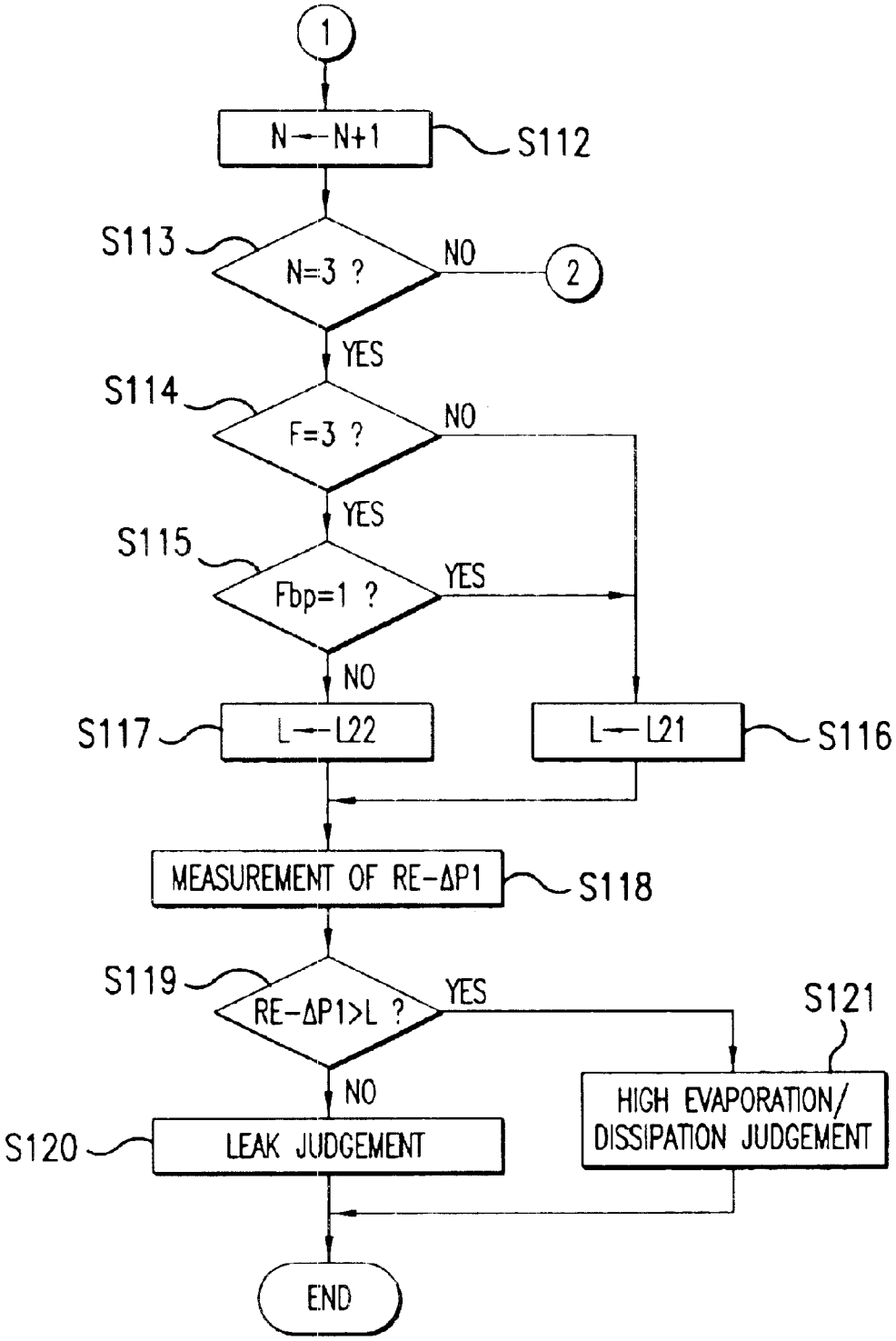
FIG. 10 is a flowchart showing the remaining part of the fault diagnosis routine continuing FIG. 9.

The ECU 11 of the fault diagnosis apparatus executes a fault diagnosis routine shown in FIGS. 9 and 10 at the time of cold start when an ignition key of the automobile is turned on, for example.

In Step S101 of the fault diagnosis routine, the ECU 11 judges whether or not a fault diagnosis condition is established, that is, whether or not a start cooling water temperature and an intake temperature are below predetermined temperatures and whether or not a fuel temperature is below a predetermined temperature, a fuel remaining amount is within a predetermined range, and so forth.

Figure 11:
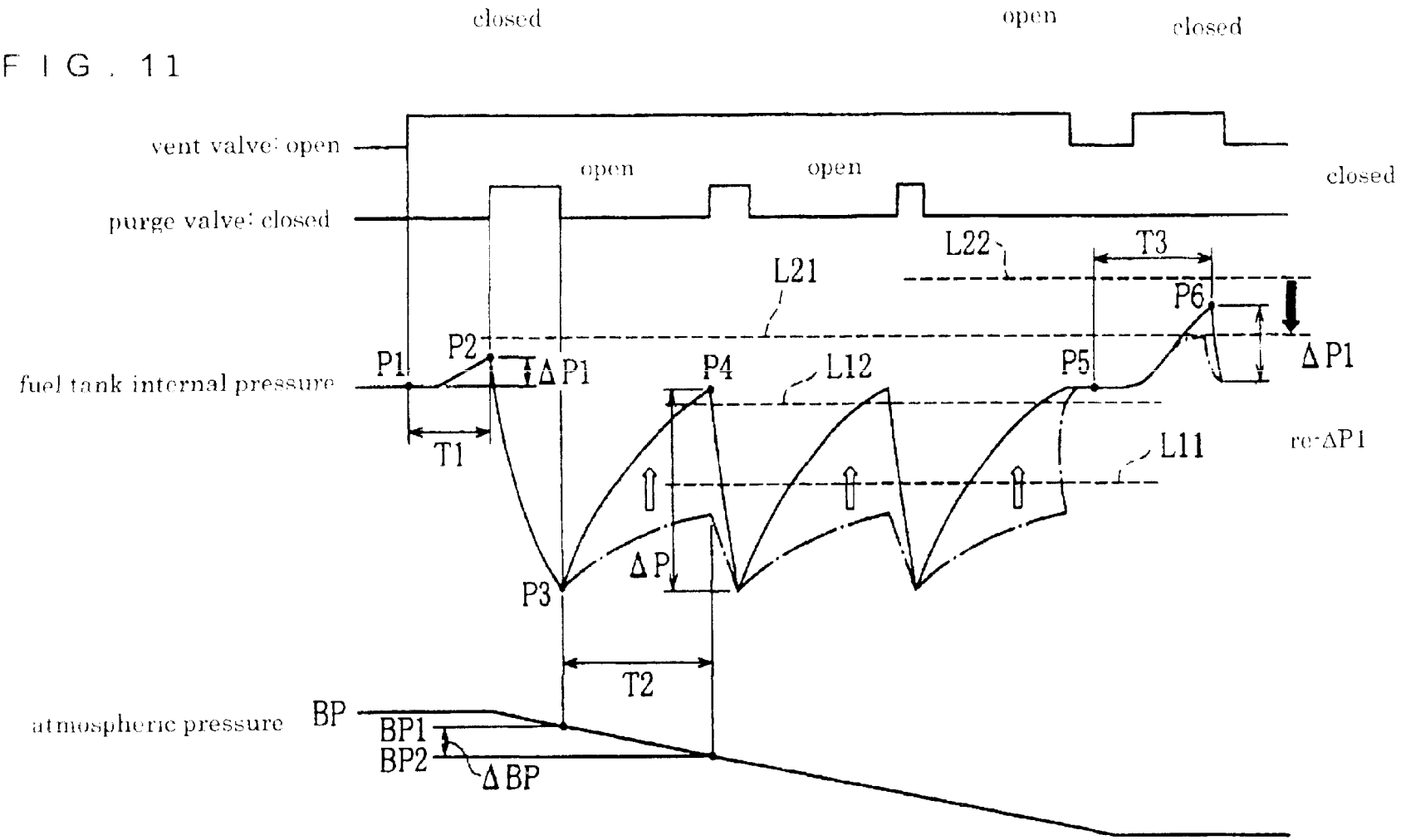
FIG. 11 is a graph showing a change of an internal pressure of a fuel tank with the passage of time during fault diagnosis.

When the fault diagnosis condition is not judged as being established in Step S101, the fault diagnosis in this cycle is finished When the fault diagnosis condition is judged as established in Step S101, on the other hand, a tank internal pressure increment amount represented by symbol ΔP1 in FIG. 11 is measured (Step S102). To measure this ΔP1, the purge valve 7 is closed while the vent valve 8 is opened so that the fault diagnosis object region of the fuel evaporation/dissipation prevention system can be released to the atmosphere. In this case, the purge valve 7 may be gradually closed. The output of the pressure sensor 10 representing the tank internal pressure P1 under this atmosphere-released state is read. When the vent valve 8 is closed after the tank internal pressure P1 is measured, the tank internal pressure rises with the passage of time as shown in FIG. 11.

The output of the pressure sensor 10 is read when a predetermined time T1 passes from the measurement point of the tank internal pressure P1, and a tank internal pressure P2 is measured at this point. Next, a tank internal pressure increment amount ΔP1 is calculated from the tank internal pressures P1 and P2, and measurement of ΔP1 in Step S102 is finished.

In the next Step S103, whether or not the tank internal pressure increment amount ΔP1 is smaller than a high evaporation/dissipation judgment value L1. When the judgment result proves NO, judgment is made to the effect that correct fault diagnosis is not possible because of the excess of the fuel evaporation/dissipation (Step S103*a*) and then fault diagnosis is finished.

On the other hand, when the tank internal pressure increment amount ΔP1 is below a leakage judgment value L1, fault judgment is further conducted. The purge valve 7 is first opened to bring the fault diagnosis object region into a reduced pressure in Step S104 in FIG. 9. When the pressure detected by the pressure sensor 10 reaches a predetermined negative pressure value indicated by symbol P3 in FIG. 11, the purge valve 7 is closed to bring the fault diagnosis object region into a closed state. In the fault diagnosis object region under this closed state, the tank internal pressure increases with the passage of time due to evaporation or leak of the fuel inside the fuel tank 1 as shown in FIG. 11. When a predetermined time T2 passes from the point of time at which the purge valve 7 is closed, the output of the pressure sensor 10 representing the tank internal pressure P4 at this point of time is read, and the tank internal pressure increment amount ΔP as the first restoring pressure amount is calculated from the tank internal pressures P3 and P4.

In the next Step S105, whether or not the first restoring pressure amount ΔP calculated in Step S104 is greater than a first judgment value L11 suitable for the judgment of ultra-trace amount leak resulting mainly from a ultra-small leak hole is judged. When the judgment result proves NO, leak abnormality is not judged as existing (Step S105*a*) and the fault diagnosis is finished.

On the other hand, when the first restoring pressure amount ΔP is greater than the first judgment value L11, whether or not the first restoring pressure amount ΔP is greater than a second judgment value L12 suitable for the judgment of trace amount leak resulting mainly from a small leak hole is judged (Step S106). When the judgment result of Step S106 proves YES, a value of a flag F representing the number of times that the first restoring pressure amount ΔP exceeds the second judgment value L12 is incremented by "1" (in Step S107). The flow then proceeds to Step S108. When the judgment result in Step S106 proves NO, that is, when the first restoring pressure amount ΔP is smaller than the second judgment value L12, on the other hand, the flow immediately proceeds from Step S6 to Step S108.

In Step S108, whether or not a flag Fbp has a value "1" representing that a decrement amount ΔBP of the atmospheric pressure BP during the measurement of the first restoring pressure amount ΔP is greater than a predetermined amount Bpa is judged. When the judgment result in this Step S108 is YES (flag Fbp=1), the control flow proceeds to Step S112 in FIG. 10.

On the other hand, when the judgment result in Step S108 is NO (Fbp≠1), that is, when the atmospheric pressure is judged not having decreased until the previous measurement of ΔP till, whether or not the decrease of the atmospheric pressure occurs during the measurement of ΔP made this time is judged. Therefore, the atmospheric pressure BP1 that is detected by the atmospheric pressure sensor 12 when the tank internal pressure reaches a predetermined negative pressure P3 and is temporarily stored in a memory and an atmospheric pressure BP2 that is detected when a predetermined time T2 passes from the arrival at the predetermined negative pressure P3 and is temporarily stored are read out from the memory, and BP2 is subtracted from BP1 to determine the atmospheric pressure decrement amount ΔBP. Furthermore, whether or not this change amount ΔBP is greater than a predetermined amount BPa is judged (Step S109). When the decrement of the atmospheric pressure greater than the predetermined amount BPa is judged as existing during measurement of the first restoring pressure amount ΔP, a value "1" is set to the flag Fbp (Step S110). When such a decrement of the atmospheric pressure is not judged as existing, a value "0" is set to the flag Fbp (Step S111).

In Step S112 following Step S108, S110 or Step S112, the number of times of measurement of the first restoring pressure amount ΔP is incremented by "1". Next, whether or not the number of times of measurement N is equal to "3" is judged (Step S113). When the number of times of measurement of the first restoring pressure amount ΔP does not reach 3, the flow proceeds to Step S104 of FIG. 2 and the first restoring pressure amount ΔP is again measured. When the first restoring pressure amount ΔP is measured three times in this way, the judgment result in Step S113 becomes YES, and whether or not the value of the flag F is "3" is judged in next Step S114.

When the judgment result in Step S114 is NO, that is, when all of the first restoring pressure amounts ΔP measured thrice are below the second judgment value L12, judgment is made tentatively that ultra-trace amount leak resulting mainly from a ultra-small leak hole exists. Next, a judgment value L used for high evaporation/dissipation judgment to be explained next is set to a third judgment value L21 suitable for discriminating ultra-trace amount leak from high evaporation/dissipation (Step S116).

By contrast, when all the first restoring pressure amounts ΔP measured thrice are judged to have exceeded the second judgment value L12 in Step S114, whether or not the flag Fbp has a value "1" is judged in next Step S115.

When the judgment result in Step S115 is NO, that is, when the atmospheric pressure does not change more than the predetermined value BPa during the thrice measurements of the first restoring pressure amount ΔP, judgment is made tentatively that trace amount leak mainly resulting from a small leak hole exists, and a high evaporation/dissipation judgment value L is set to a fourth judgment value L22 suitable for discriminating trace amount leak from high evaporation/dissipation (Step S117).

On the other hand, when the judgment result in Step S115 is YES, that is, the drop of the atmospheric pressure exceeding the predetermined value BPa is detected even once during the thrice measurements of the first restoring pressure amount ΔP, the high evaporation/dissipation judgment value L is set to a third judgment value 21 suitable for trace amount leak judgment and smaller than the fourth judgment value L22 although judgment is made in Step S114 that the first restoring pressure amount ΔP is great and the possibility of trace amount leak exists (Step S115).

In other words, when the atmospheric pressure BP decreases by a value greater than the predetermined pressure during the measurement of ΔP due to driving on a slope having an acute gradient, the measurement value of the fuel tank internal pressure by the pressure sensor 10 comprising the relative pressure sensor increases relatively from a tank internal pressure change curve indicated by one-dot-chain line in FIG. 11 towards a curve indicated by solid line as indicated by white arrow. Therefore, when high evaporation/dissipation judgment is made by use of the judgment value L that is the same as the high evaporation/dissipation judgment value during driving on a flat land without involving the drop of the atmospheric pressure, the judgment value L becomes excessive by the decrement of the atmospheric pressure and erroneous judgment of the existence of leak abnormality is likely to be made although leak abnormality does not exist in practice.

Figure 12:
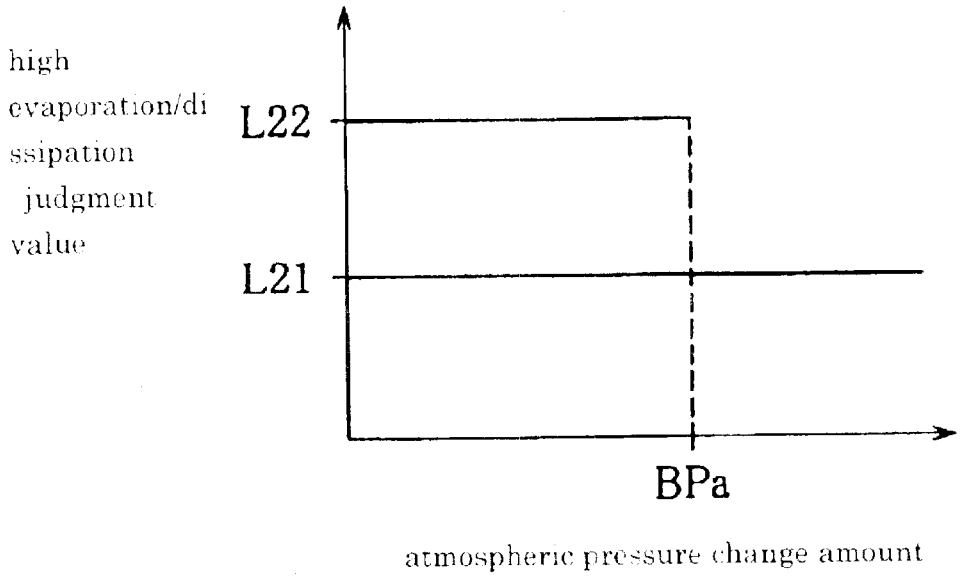
FIG. 12 is a graph showing the relation of a high evaporation/dissipation judgment value L used in the fault diagnosis routine shown in FIGS. 9 and 10 and an atmospheric pressure decrement amount $\Delta BP$ during measurement of a first restoring pressure amount $\Delta P$.

In this point, when the fourth judgment value L22 is replaced with the third judgment value L21 in Step S115, as indicated by thick downward arrow in FIG. 11 and as also shown in FIG. 12, at the time of the drop of the atmospheric pressure even when the first restoring pressure amount is great, the fourth judgment value L22 is corrected to decrease and the erroneous judgment can be avoided.

In Step S118 of the fault diagnosis routine, the purge valve 7 is closed while the vent valve 8 is opened to release the fault diagnosis object region to the atmosphere. After the pressure sensor 10 measures the tank internal pressure P5 under this released state, the vent valve 8 is closed to bring the fault diagnosis object region into the closed state. Under this closed state, the tank internal pressure increases with the passage of time as shown in FIG. 11. When a predetermined time T3 passes from the finish point of the measurement of the tank internal pressure P5, the output of the pressure sensor 10 is read, the tank internal pressure P6 at this point is measured, and re-ΔP1 as the second restoring pressure amount is calculated from the tank internal pressures P5 and P6.

In the next Step S119, whether or not this re-ΔP1 is greater than the judgment value L set in Step S116 or S117. When the judgment result proves NO, final judgment is made in Step 120 to the effect that leak exists. When the judgment result in Step 119 proves YES, on the other hand, judgment is made to the effect that because the increase of the first restoring amount ΔP results from high evaporation/dissipation, the tentative judgment to the effect that leak exists must be withdrawn (Step S121), and the fault diagnosis is finished without making the leak judgment.

The fourth judgment value L22 used for the final judgment at the time of the decrease of the atmospheric pressure is corrected to decrease as described above, the possibility that leak abnormality is erroneously judged to exist due to the excess of this judgment value by the decrement of the atmospheric pressure can be reduced. Incidentally, when leak is judged as existing in Step S120, the leak judgment result is notified by use of an alarm lamp or an alarm buzzer.

In summary, the first and second judgment values L11 and L12 in this embodiment are set in association with ultra-trace amount leak and trace amount leak, respectively, and the third and fourth judgment values L21 and L22 are set so that abnormality resulting from ultra-trace amount leak and trace amount leak can be discriminated from abnormality resulting from evaporation/dissipation of the fuel.

When the first restoring pressure amount ΔP exceeds the first judgment value L11 as the judgment criterion of the ultra-trace amount leak and is below the second judgment value L12 as the judgment criterion of trace amount leak, abnormality resulting from the ultra-trace amount leak is tentatively judged. Next, the second restoring pressure amount (re-ΔP1) is measured in order to judge whether such increase of the first restoring pressure amount results from ultra-trace amount leak or from excessive evaporation/dissipation of the fuel.

When the second restoring pressure amount exceeds the third judgment value L21, evaporation/dissipation of the fuel is judged as the cause of the increase of the first restoring pressure amount ΔP, and tentative judgment of ultra-trace amount leak abnormality is withdrawn and final judgment is made to the effect that existence/absence of ultra-trace amount leak is not known (diagnosis by high evaporation/dissipation judgment is invalidated). On the other hand, when the second restoring pressure amount does not exceed the third judgment value, ultra-trace amount leak is judged as being the cause of the increase of the first restoring pressure amount, and ultra-trace amount leak abnormality is judged finally.

When the first restoring pressure amount ΔP exceeds the second judgment value L12, abnormality resulting from trace amount leak is tentatively judged. Next, the second restoring pressure amount (re-ΔP1) is measured for judging the cause of the increase of the first restoring pressure amount. When the second restoring pressure amount exceeds the fourth judgment value L22, evaporation/dissipation of the fuel is judged as the cause of the increase of the first restoring pressure amount ΔP, and final judgment is made to the effect that existence/absence of trace amount leak is not known (diagnosis by high evaporation/dissipation judgment is invalidated). When the second restoring pressure amount does not exceed the fourth judgment value L22, on the other hand, trace amount leak is judged as the cause of the increase of the first restoring pressure amount and final judgment is made to the effect that trace amount leak exists. It becomes thus possible to accurately judge ultra-trace amount leak and trace amount leak.

Since this embodiment uses the pressure sensor 10 for detecting the relative pressure inside and outside the fuel tank to measure the fuel tank internal pressures P1 to P6, there is a possibility that the measurement value relatively increases by the decrement of the atmospheric pressure when the atmospheric pressure drops during the measurement of the tank internal pressure, so that leak judgment is likely to be erroneous. However, when the atmospheric pressure drops more than the predetermined amount BPa during measurement of ΔP, the fourth judgment value L22 to be compared with the second restoring pressure amount (re-ΔP1) in the subsequent high evaporation/dissipation judgment is corrected so as to decrease. Therefore, this embodiment can correctly judge existence/absence of trace amount leak abnormality without affected by the change of the atmospheric pressure. Because the decrement correction of the fourth judgment value L22 is made by replacing the fourth judgment value L22 by the third judgment value L21, the construction relating to the leak judgment and the judgment procedure become simple.

Additionally, the ECU 11 of the fault diagnosis apparatus operates as first diagnosis means for comparing the first restoring pressure amount ΔP measured after pressure reduction of the fault diagnosis object region with the first judgment value L11 or the second judgment value L12, as second diagnosis means for comparing the second restoring pressure value (re-ΔP1) measured under the closed state after the fault diagnosis object region is released to the atmosphere with the third judgment value L21 or the fourth judgment value L22, as abnormality judgment means for judging abnormality of the fuel evaporation/dissipation prevention system on the basis of the first and second restoring pressure amounts, and as correction means for correcting and decreasing the fourth judgment value L22 when the atmospheric pressure drops.

The present invention is not limited to the third embodiment described above, but can be changed or modified in various ways.

For example, in the embodiment described above, the fourth judgment value L22 is so corrected as to decrease when the drop of the atmospheric pressure beyond the predetermined amount BPa is detected at least once during the thrice measurements of ΔP. However, this decreasing correction may be conducted when the drop of the atmospheric pressure is detected a plurality of times or when the maximum value, the minimum value or the mean value of the drop of the atmospheric pressure exceeds the predetermined amount BPa during the thrice measurement of ΔP. Incidentally, ΔP measurement is not limited to three times.

Figure 13:
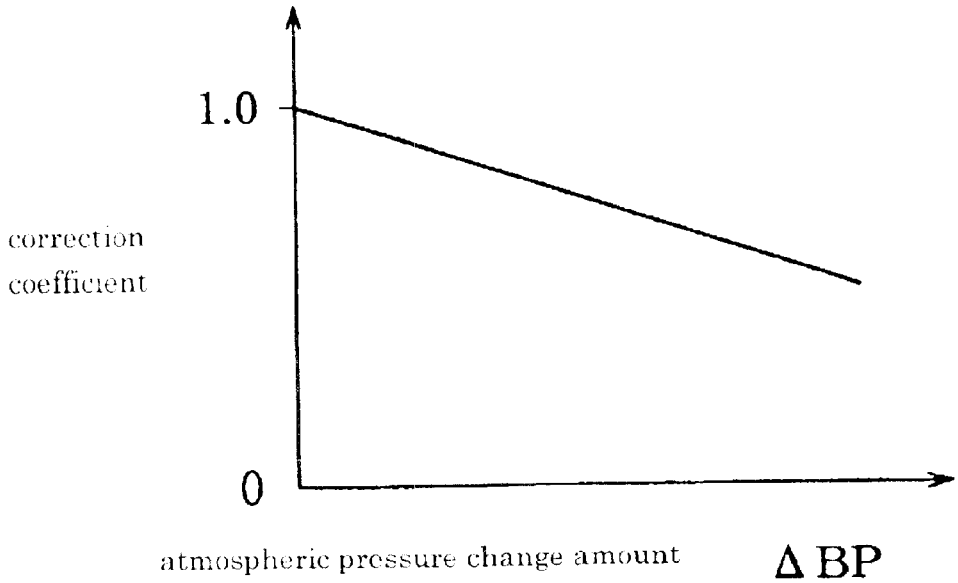
FIG. 13 is a graph showing the relation between a correction coefficient KL used for setting the high evaporation/dissipation judgment value L in the fault diagnosis routine in a modified embodiment of the invention and the atmospheric pressure decrement amount $\Delta BP$.

It is not essentially necessary to correct and decrease step-wise the high evaporation/dissipation judgment value L from L22 to L21 as shown in FIG. 12 when the atmospheric pressure decrement amount ΔBP is greater than the predetermined value BPa. The judgment value L may be corrected and decreased by multiplying the judgment value L by a correction coefficient KL, that decreases from a value 1 when the atmospheric pressure decrement amount ΔBP increases, as shown in FIG. 13.

In the embodiment described above, only the fourth judgment value L22 is corrected and decreased when the atmospheric pressure drops. However, both of the third and fourth judgment values L21 and L22 may be corrected. In this case, it is possible to correct step-wise each judgment value corresponding to the predetermined amount BPa or to correct it step-wise corresponding to a plurality of predetermined amounts as shown in FIG. 12, or to correct it so as to gradually decrease as shown in FIG. 13.

In the embodiment described above, the third and fourth judgment values L21 and L22 remain constant irrespective of the first restoring pressure amount ΔBP. However, it is also possible to variably set both judgment values L21 and L22 in accordance with the first restoring pressure amount ΔP or to variably set one of both judgment values that is to be compared with the second restoring pressure amount (re-ΔP1) in accordance with ΔP. Also in this modified embodiment, when the drop of the atmospheric pressure exceeding the predetermined pressure occurs during ΔP measurement either one, or both, of the third and fourth judgment values L21 and L22 may be corrected to decrease. This correction is preferably made in accordance with the decreasing amount of the atmospheric pressure.

Figure 14:
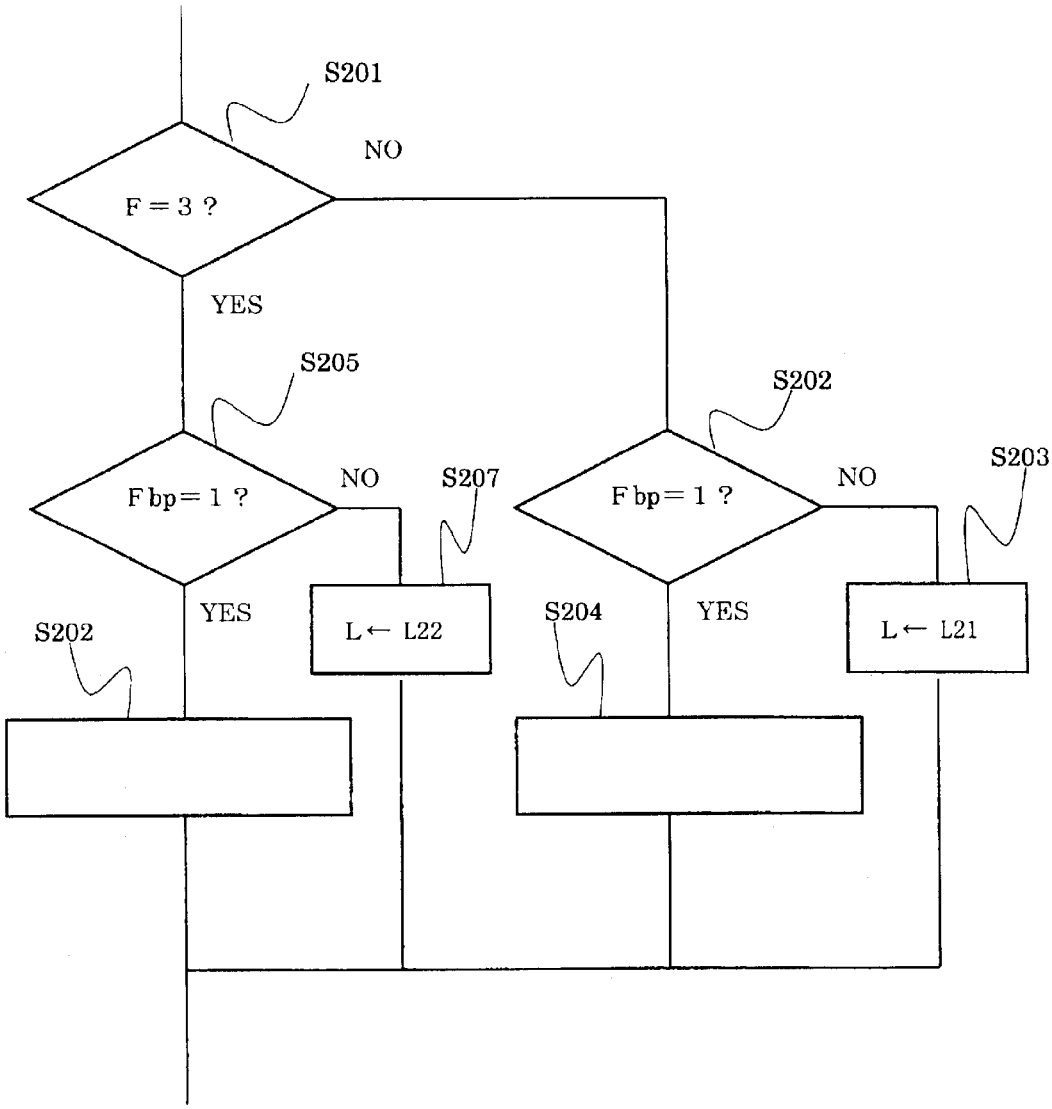
FIG. 14 is a flowchart for setting the high evaporation/dissipation judgment value L in accordance with the decrement amount of the atmospheric pressure in the fault diagnosis routine in the modified embodiment of the present invention.

In this case, the third judgment value L21 or the fourth judgment value L22 maybe set in accordance with the decreasing amount of the atmospheric pressure in Steps S201 to S205 in FIG. 14 in place of Steps S114 to 117 in FIG. 10 in the third embodiment.

In Step S201 in FIG. 14, whether or not the value of the flag F is "3" is judged.

When the judgment result of Step S201 proves NO, that is, when any of the first restoring pressure amount ΔP measured three times is judged below the second judgment value L12, judgment is made tentatively to the effect that ultra-trace leak resulting mainly from the ultra-small leak hole exists. In Step S202, whether or not the flag Fbp has a value "1" representing that the decrement amount ΔBP of the atmospheric pressure BP during measurement of the first restoring pressure amount ΔP is greater than the predetermined amount BPa is judged. When the judgment result in this Step S108 proves YES (flag Fbp=1), the flow proceeds to Step S203 and the third judgment value L21 is set in accordance with the decrement amount of the atmospheric pressure. On the other hand, when this judgment result proves NO, the judgment value L used for the high evaporation/dissipation judgment in Step 204 is set to the third judgment value L21 suitable for discriminating the ultra-trace amount leak from high evaporation/dissipation.

By contrast, when Step S201 judges that all the first restoring pressure amounts ΔP measured thrice exceed the second judgment value L12 in Step S201, judgment is made tentatively to the effect that trace amount leak resulting mainly from the small leak hole exists, and whether or not the flag Fbp has the value "1" is judged in the next Step S205.

In Step S205, whether or not the flag Fbp has the value "1" representing that the decrement amount ΔBP of the atmospheric pressure BP during measurement of the first restoring pressure amount ΔP exceeds the predetermined amount BPa is judged. When the judgment result in this Step S108 proved YES (flag Fbp=1), the flow proceeds to Step S206 and the fourth judgment value L22 is set in accordance with the decrement amount of the atmospheric pressure. When the judgment result proves NO, on the other hand, the judgment value L used for high evaporation/dissipation judgment in Step S207 is set to the fourth judgment value L22 suitable for discriminating trace amount leak from high evaporation/dissipation.

The invention can be changed or modified in various other ways within the scope thereof.

What is claimed is:

1. A fault diagnosis apparatus of a fuel evaporation/dissipation prevention system for collecting an evaporated fuel occurring inside a fuel tank into a canister and introducing the evaporated fuel into an intake passage of an internal combustion engine, comprising:

first diagnosis means for serially comparing a first restoring pressure amount measured after a fault diagnosis object region of said fuel evaporation/dissipation prevention system is brought into a reduced pressure state, with a first judgment value and with a second judgment value greater than said first judgment value;

second diagnosis means for measuring a second restoring pressure amount by sealing said fault diagnosis object region after an atmospheric pressure is introduced into said fault diagnosis object region when said first restoring pressure amount measured by said first diagnosis mean is greater than said first judgment value or said second judgment value, then comparing said second restoring pressure amount with a third judgment value when said first restoring pressure amount is greater than said first judgment value but is smaller than said second judgment value, and comparing said second restoring pressure amount with a fourth judgment value greater than said third judgment value when said first restoring pressure amount is greater than said second judgment value; and abnormality judgment means for judging said fuel evaporation/dissipation prevention system as being abnormal when said first restoring pressure amount measured by said first diagnosis means is greater than said first judgment value but is smaller than said second judgment value and said second restoring pressure amount measured by said second diagnosis means is smaller than said third judgment value, or when said first restoring pressure amount is greater than said second judgment value and said second restoring pressure amount is smaller than said fourth judgment value.

2. A fault diagnosis apparatus of a fuel evaporation/dissipation prevention system for collecting an evaporated fuel occurring inside a fuel tank into a canister and introducing the evaporated fuel into an intake passage of an internal combustion engine, comprising:

first diagnosis means for comparing a first restoring pressure amount measured after a fault diagnosis object region of said fuel evaporation/dissipation prevention system is brought into a reduced pressure state, with a first predetermined value;

second diagnosis means for comparing a second restoring pressure amount measured under a sealed state of said fault diagnosis object region after an atmospheric pressure is introduced into said fault diagnosis object region, with a second predetermined value set in accordance with said first restoring pressure amount when said first restoring pressure amount measured by said first diagnosis means is greater than said first predetermined value; and abnormality judgment means for judging said fuel evaporation/dissipation prevention system as being abnormal when said first restoring pressure amount measured by said first diagnosis means is greater than said first predetermined value and said second restoring pressure amount measured by said second diagnosis means is smaller than said second predetermined value.

3. A fault diagnosis apparatus of a fuel evaporation/dissipation prevention system according to claim 2, wherein said first diagnosis means measures said first restoring pressure amount after a set time passes from completion of pressure reduction of said fault diagnosis object region, and said second diagnosis means sets said second predetermined value to a greater value when said first restoring pressure amount measured by said first diagnosis means is greater.

4. A fault diagnosis apparatus of a fuel evaporation/dissipation prevention system for collecting an evaporated fuel occurring inside a fuel tank into a canister and introducing the evaporated fuel into an intake passage of an internal combustion engine, comprising:

first diagnosis means for serially comparing a first restoring pressure amount measured after a fault diagnosis object region of said fuel evaporation/dissipation prevention system is brought into a reduced pressure state, with a first judgment value and a second judgment value greater than said first judgment value;

second diagnosis means for measuring a second restoring pressure amount by sealing said fault diagnosis object region after an atmospheric pressure is introduced into said fault diagnosis object region when said first restoring pressure amount measured by said first diagnosis mean is greater than said first judgment value or said second judgment value, then comparing said second restoring pressure amount with a third judgment value when said first restoring pressure amount is greater than said first judgment value but is smaller than said second judgment value, and comparing said second restoring pressure amount with a fourth judgment value greater than said third judgment value when said first restoring pressure amount is greater than said second judgment value;

abnormality judgment means for judging said fuel evaporation/dissipation prevention system as being abnormal when said first restoring pressure amount measured by said first diagnosis means is greater than said first judgment value but is smaller than said second judgment value and said second restoring pressure amount measured by said second diagnosis means is smaller than said third judgment value, or when said first restoring pressure amount is greater than said second judgment value and said second restoring pressure amount is smaller than said fourth judgment value; and correction means for correcting and decreasing said fourth judgment value to be compared by said second diagnosis means with said second restoring pressure amount when the atmospheric pressure changes and decreases while said first diagnosis means measures said first restoring pressure amount.

5. A fault diagnosis apparatus of a fuel evaporation/dissipation prevention system according to claim 4, wherein said correction means corrects and decreases said fourth judgment value in accordance with the decrement of the atmospheric pressure while said first diagnosis means measures said first restoring pressure amount.

6. A fault diagnosis apparatus of a fuel evaporation/dissipation prevention system according to claim 4, wherein said correction means replaces said fourth judgment value by said third judgment value when the atmospheric pressure changes and decreases beyond a predetermined pressure while said first diagnosis means measures said first restoring pressure amount.

7. A fault diagnosis apparatus of a fuel evaporation/dissipation prevention system for collecting an evaporated fuel occurring inside a fuel tank into a canister and introducing the evaporated fuel into an intake passage of an internal combustion engine, comprising:

first diagnosis means for serially comparing a first restoring pressure amount measured after a fault diagnosis object region of said fuel evaporation/dissipation prevention system is brought into a reduced pressure state, with a first judgment value and with a second judgment value greater than said first judgment value;

second diagnosis means for measuring a second restoring pressure amount by sealing said fault diagnosis object region after an atmospheric pressure is introduced into said fault diagnosis object region when said first restoring pressure amount measured by said first diagnosis mean is greater than said first judgment value or said second judgment value, then comparing said second restoring pressure amount with a third judgment value set in accordance with said first restoring pressure amount when said first restoring pressure amount is greater than said first judgment value but is smaller than said second judgment value, and comparing said second restoring pressure amount with a fourth judgment value set in accordance with said first restoring pressure amount when said first restoring pressure amount is greater than said second judgment value;

abnormality judgment means for judging said fuel evaporation/dissipation prevention system as being abnormal when said first restoring pressure amount measured by said first diagnosis means is greater than said first judgment value but is smaller than said second judgment value and said second restoring pressure amount measured by said second diagnosis means is smaller than said third judgment value, or when said first restoring pressure amount is greater than said second judgment value and said second restoring pressure amount is smaller than said fourth judgment value; and correction means for correcting and decreasing said third judgment value or said fourth judgment value to be compared by said second diagnosis means with said second restoring pressure amount when the atmospheric pressure changes and decreases while said first diagnosis means measures said first restoring pressure amount.

8. A fault diagnosis apparatus of a fuel evaporation/dissipation prevention system according to claim 7, wherein said correction means corrects and decreases said third judgment value or said fourth judgment value in accordance with the decrement of the atmospheric pressure during measurement of said first restoring pressure amount by said first diagnosis means.

* * * * *